United States Patent [19]

Swaney

[11] Patent Number: 4,819,795

[45] Date of Patent: Apr. 11, 1989

[54] PACKAGE FOR FOOTWEAR

[76] Inventor: John W. Swaney, 8 Stintons Road, Donvale, Victoria, Australia, 3111

[21] Appl. No.: 144,480

[22] Filed: Jan. 15, 1988

Related U.S. Application Data

[63] Continuation-in-part of Ser. No. 23,805, Dec. 2, 1987, abandoned.

[51] Int. Cl.[4] ..... B65D 85/18

[52] U.S. Cl. ..... 206/278; 206/508; 206/518; 220/22; 220/4 B; 220/4 D; 220/367

[58] Field of Search ..... 206/278, 503, 508, 518, 206/520, 557, 561; 220/4 B, 4 D, 22, 367; 229/DIG. 14

[56] References Cited

U.S. PATENT DOCUMENTS

| | | | |
|---|---|---|---|
| 1,790,119 | 1/1931 | Stevens | 206/278 |
| 1,921,110 | 8/1933 | Wheary | 206/278 |
| 3,244,311 | 4/1966 | Lawson | 220/4 B |
| 3,412,888 | 11/1968 | Andrews et al. | 220/4 B |
| 3,920,144 | 11/1975 | Callen | 220/22 |
| 3,942,707 | 3/1976 | Schidlowski et al. | 220/307 |
| 4,014,450 | 3/1977 | Girotti et al. | 220/4 B |
| 4,183,446 | 1/1980 | Davis | 220/4 B |
| 4,235,338 | 11/1980 | Dugan et al. | 220/4 B |
| 4,494,650 | 1/1985 | Cullen | 220/4 B |
| 4,703,850 | 11/1967 | Walker | 206/293 |

FOREIGN PATENT DOCUMENTS

| | | | |
|---|---|---|---|
| 5602759 | 6/1960 | Australia . | |
| 3407163 | 2/1965 | Australia . | |
| 4965369 | 7/1970 | Australia . | |
| 2407177 | 4/1977 | Australia . | |
| 5486980 | 1/1980 | Australia . | |
| 5612380 | 3/1980 | Australia . | |
| 2183783 | 2/1983 | Australia . | |
| 2718284 | 4/1984 | Australia . | |
| 568779 | 7/1958 | Belgium | 206/278 |
| 111883 | 8/1965 | Netherlands | 220/4 B |
| 2147883 | 2/1984 | United Kingdom . | |

*Primary Examiner*—David T. Fidei

*Attorney, Agent, or Firm*—Cushman, Darby & Cushman

[57] ABSTRACT

A molded plastic shoe box including a housing with flared sidewalls and a lid. The housing is provided with at least one pair of closely spaced partition walls which provide a baffle wall dividing the interior of the housing into compartments, and prevent complete nesting when two like housings are placed one within the other. The led has a raised perimeter to prevent sliding when closed like boxes are stacked on one another. The lid is shaped to permit stacking with like lids and is vented to permit circulation of air into and from the closed box.

5 Claims, 9 Drawing Sheets

PACKAGE FOR FOOTWEAR

CROSS-REFERENCE TO RELATED APPLICATION

This application is a Continuation-In-Part of Applicant's earlier U.S. patent application No. 023,805 entitled "Improved Package For Footwear" filed on 2nd December 1987 now abandoned.

BACKGROUND OF THE INVENTION

The invention relates generally to the packaging of articles and more particularly to an improved package for footwear.

Traditionally, many types of footwear such as shoes and boots have been packaged in rectangular cardboard shoe boxes open at one side with a lid for closing that side. Although shoe boxes of this type have been in use for many years, they suffer from several disadvantages particularly in connection with the storage of shoes in such boxes prior to sale. Generally the shoe boxes are stacked in rows, one on top of the other, either in a store room or in the sales area. As such, the lower rows of shoe boxes are subjected to relatively heavy loads by the upper rows, leading to a tendency for the cardboard boxes to crush. This problem is magnified due to the constant handling of the boxes due to purchasers requirements to try on a selection of sizes and styles before buying. The crushing of the shoe box can lead to damage of the shoes contained therein by scuffing and the like.

Furthermore, storage of shoes in the above manner and with boxes of the type described causes handling problems. For example, difficulties can be encountered in removing a shoe box from a lower row. This is usually done by gripping the lid which can result in the lid tearing. As such it has not been the practice in the past to try and reuse the boxes and this can create relatively large waste disposal problems particularly if the purchaser does not want the shoe box.

A further problem in stacking the boxes is that, when stacked, the stack tends to be unstable- due to the constant removal and replacement of the shoe boxes. Yet another problem is that the boxes are totally unsatisfactory for display purposes as they do not enable the customer to have any knowledge of what the shoe looks like other than the information provided on the label.

SUMMARY OF THE INVENTION

It is therefore an object of the present invention to provide an improved footwear package which alleviates one or more of the foregoing disadvantages.

Accordingly, the invention provides a shoe box comprising a housing for containing footwear, said housing having a base, an open top, opposed side walls and opposed end walls, a lid for covering said top, said housing and lid being formed of plastics material moulded to the desired shape and having some flexibility when moulded and sufficient rigidity to support thereon, a considerable number of like shoe boxes containing footwear when said boxes are stacked, said walls extending upwardly and outwardly from said base, to form a slightly tapering housing, at least one pair of closely spaced partition walls extending inside said housing on said base and having a height sufficient to support a baffle wall for dividing said housing into smaller compartments and to prevent complete nesting when one housing is placed within another, said lid having a flat top, a raised perimeter portion around said flat top and downwardly depending sides for extending over the upper part of the walls of said housing, said sides being normal to said flat top and said flat top accommodating the base of a further box when a plurality of boxes are stacked whereby said raised perimeter portion prevents sliding movement between the stacked boxes, means on said lid for facilitating stacking of a plurality of lids and said lid having vent means for enabling a small amount of air to circulate into said housing when said lid is placed thereon.

BRIEF DESCRIPTION OF THE DRAWINGS

In order that the invention may be more readily understood, particular embodiments will now be described with reference to the accompanying drawings wherein.

DETAILED DESCRIPTION

Figure 1:
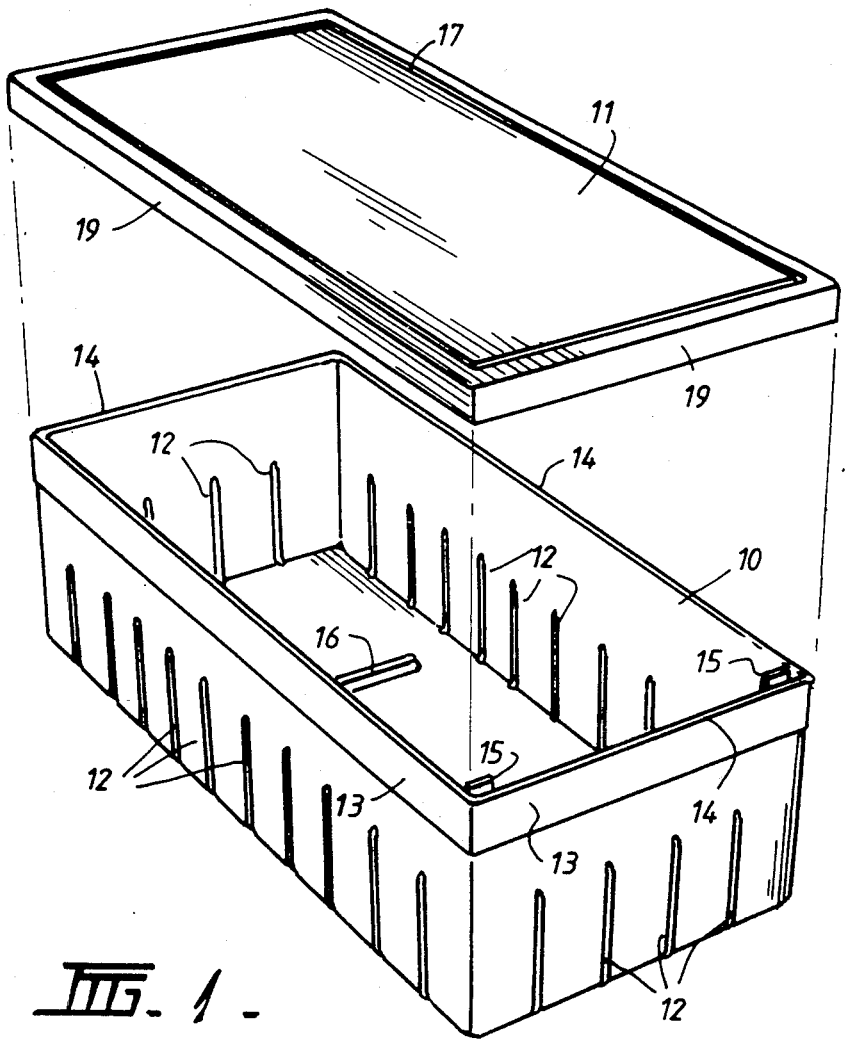
FIG. 1 is a perspective view from above of a shoe box and lid according to one embodiment of the invention with lid raised.
Figure 2:
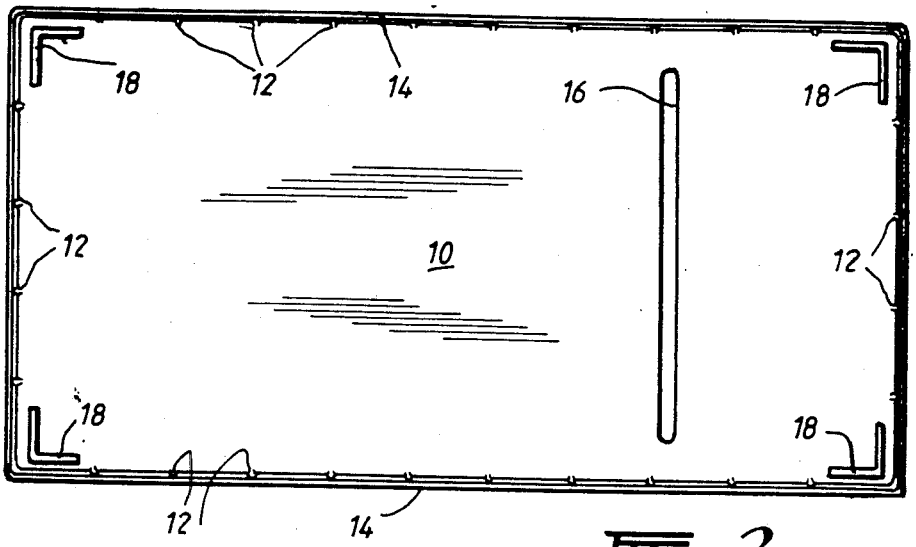
FIG. 2 is an underside view of the box shown in FIG. 1.
Figure 3:
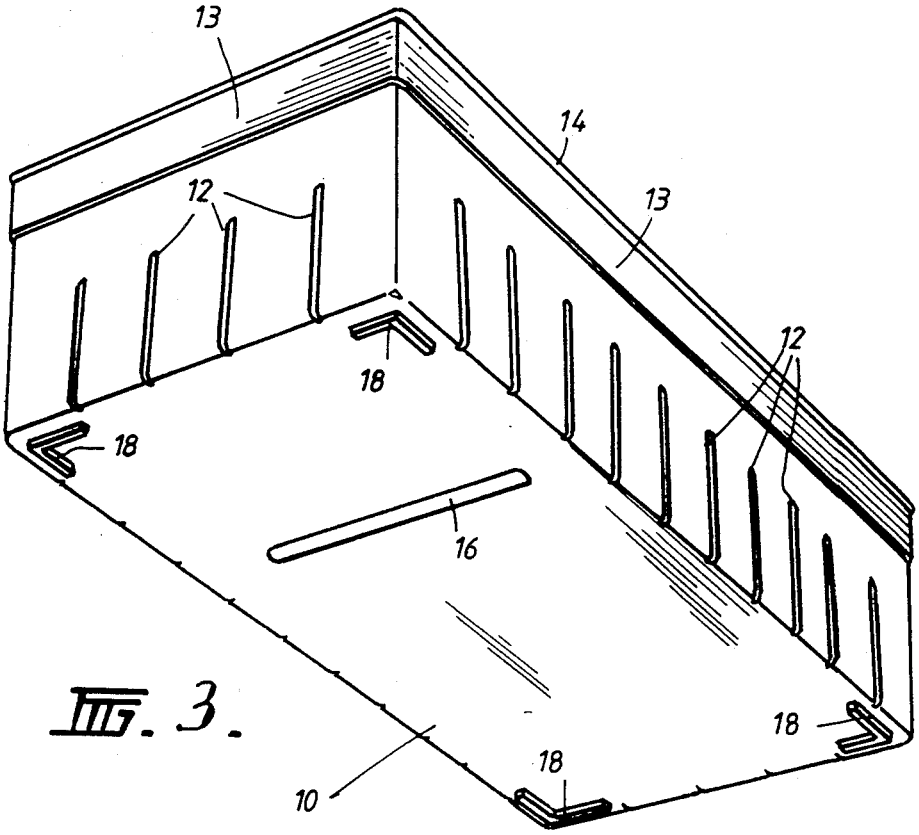
FIG. 3 is a perspective view from below of the shoe box shown in FIG. 1 with lid removed.

Referring now to the drawings and firstly to the embodiment of FIGS. 1 to 4, the shoe box or package is shown to consist essentially of a box-shaped housing 10 and a lid 11 which is shown separate from the housing 10, that is, in the open or removed condition. The housing 10 and lid 11 are formed of a clear plastics material such that the package is transparent enabling goods packaged therein to be viewed from outside the package. Since the package is of necessity very thin walled, ribs 12 are provided around the housing 10 for the purpose of providing additional strength and furthermore an enlarged section 13 is provided around the top of the housing again for providing additional strength.

The box-shaped housing 10 is turned outwardly around the top edge thereof which defines an open side of the housing to form a lip 14 for engagement with the lid 11 as will be apparent hereinbelow. Baffle members 15 define vertical slots inside the housing 10 at one end thereof for the purpose of enabling a card to be slid inside the box and retained in position. The card may have display information which is visible through an end wall of the housing 10. A ridge 16 on the inside of the base of the housing 10 provides a heel stop for retaining shoes in position within the housing 10.

Figure 4:
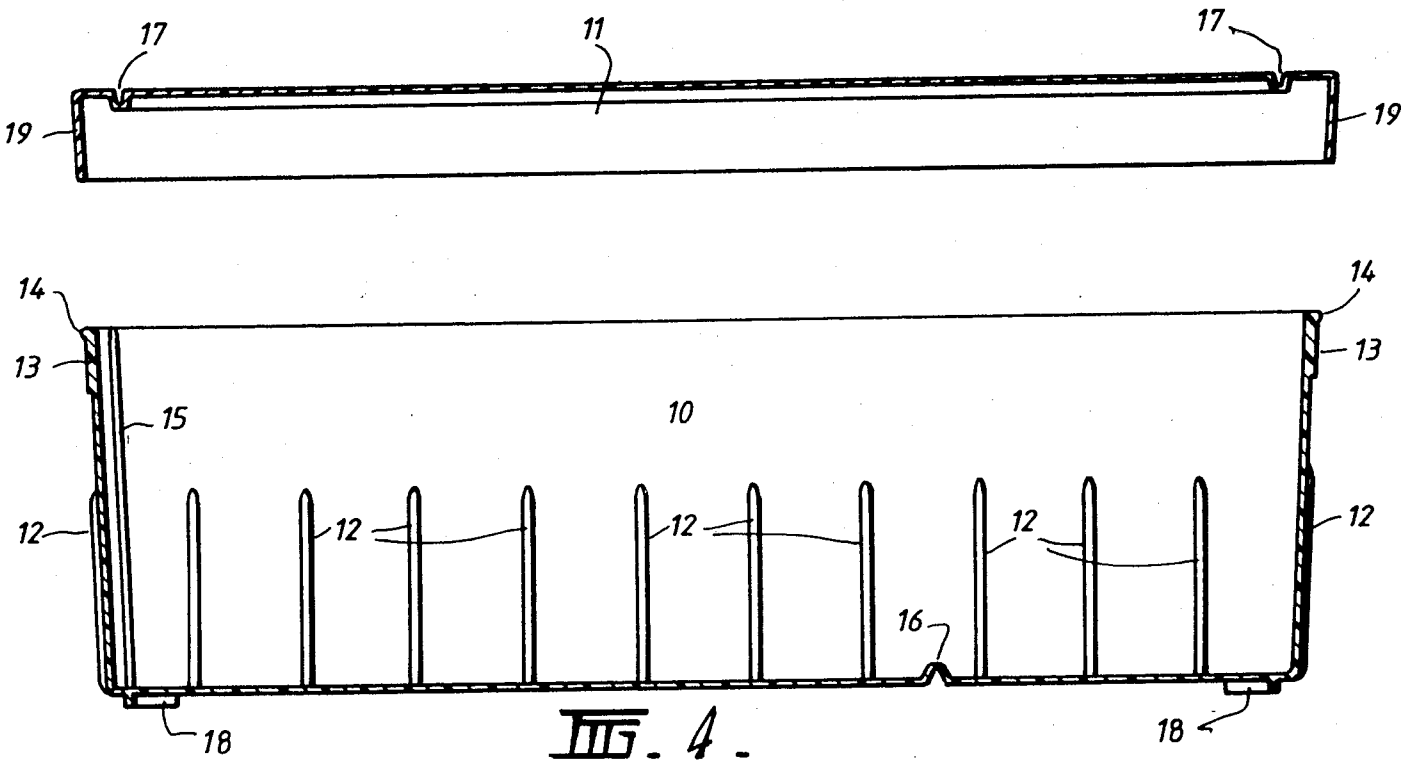
FIG. 4 is a sectional side elevation of the box and lid shown in FIG. 1.
Figure 5:
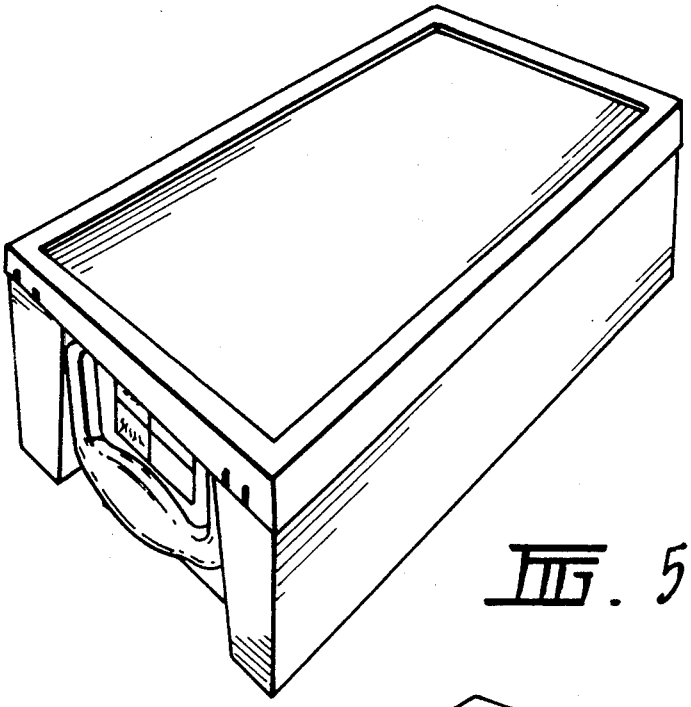
FIG. 5 is a perspective front view from above of a shoe box and lid according to another embodiment of the invention with lid closed.
Figure 6:
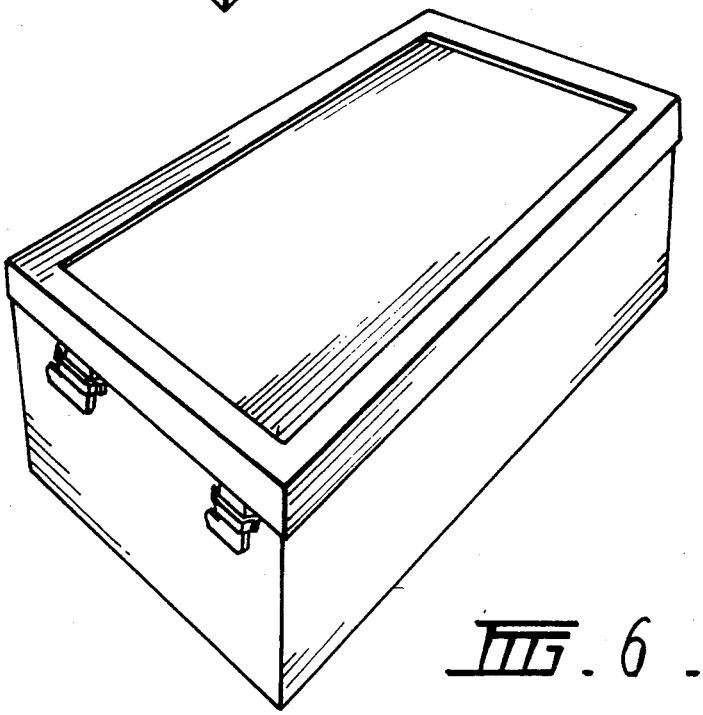
FIG. 6 is a perspective rear view from above of the shoe box of FIG. 5.

As is evident in FIGS. 1 and 4 the lid 11 has a continuous groove 17 which extends around the perimeter thereof on the outer side. As can be seen most clearly in FIG. 3, the bottom of the housing 10 has a right angled ridge member 18 adjacent each corner thereof and the arrangement is such that when one package is stacked on top of another, the ridge members 18 on the underside of one package fit into the groove 17 on the lid of the package therebelow for the purpose of preventing sliding movement between packages in a stack such that the stability of the stack is considerably improved. As will be evident to persons skilled in the art the groove 17 on the lid 11 could equally be a raised ridge member which could be positioned to fit immediately outside the ridge members 18 and the same result would be achieved.

As is more evident in FIG. 4, the box-shaped housing 10 has a tapered construction which is exaggerated for the purposes of illustration in FIG. 4. In other words, the housing 10 has greater dimensions at the top than at the bottom such that the sides incline inwardly a slight amount. The purpose of this tapered construction is to enable one box-shaped housing 10 to fit inside another housing 10 so that a plurality of such housings may be stacked one inside the other, thus occupying minimum space during packaging and transportation or minimum space for storage after use or storage for disposal purposes. In other words, the housings are nestable and the lid 11 is similarly tapered so that a plurality of the lids are also nestable.

The package according to this particular embodiment is 300 mm long, 150 mm wide and 100 mm deep although it will be evident that other sizes may be used to accommodate different shoes such as womens' and childrens' shoes. FIG. 4 shows the lid 11 to be very similar to a conventional boxtype lid with the exception that it is formed out of the same plastics material as the housing 10. If it is preferred the lid 11 may have an inwardly directed ridge (not shown) around the inside of the downwardly depending sides 19 thereof to engage the lip 14 of the box so as to hold the lid firmly in place when it is arranged on the box 10. Alternatively, the lid may be as shown in FIG. 4 in which case it merely slides over the lip 14 or, if desired, in this situation the lip 14 may be omitted.

The plastics housing 10 and lid 11 may be manufactured by injection moulding or any other suitable method.

Whilst the package described above is produced in transparent plastics material enabling the contents thereof (shoes) to be viewed from outside the package, clearly it could be made in translucent or opaque plastics material. The package may be manufactured in plastics of various different colours. Obviously the strengthening ribs 12 and the enlarged section 13 may be varied according to strength requirements and the particular material or process being used to manufacture the package and it is only important that the final product have sufficient strength to support a reasonable load of similar packages thereon. Generally, the package should be able to withstand a load of 3.2 kgs thereon without collapsing. The inside of the housing 10 may have support means (not shown) for supporting an insert which enables shoes therein to be displayed in the box particularly in cases where the plastics material is translucent or opaque. Such an insert would raise the shoes in a manner which is generally known per se.

Reference should now be made to FIGS. 5–8 which show another embodiment of the invention wherein the lid 11 is connected to the housing 10 by flexible hinges 20 arranged at one end of the lid 11. The hinges 20 are moulded as part of the lid and connect to the housing 10 by passing through slots formed by brackets 21 which are affixed to one end of the housing 10. The brackets 21 may be glued or otherwise attached to the housing or may be moulded integral therewith. The hinges 20 are hook-shaped as shown and require minor distortion in order to pass through the slots whereby they are retained in position.

The box or package of FIGS. 5–8 is moulded of plastics material and in the case of both the housing 10 and lid 11 the thickness of the material is greater than in the previous embodiment. Thus a box or package of stronger construction is obtained and the need for the ribs 12 is obviated. As is evident in the drawings a handle 22 is arranged at the opposite end of the housing 10 to the hinge brackets 21. The handle 22 is accommodated in a recess formed in the end of the housing 10 by means of inturned wall portions 23. The inturned wall portions 23 provide added strength to the housing and provide surfaces to which the handle is pivotally connected by hinge pins (not shown). In a retracted position the handle fits totally within the recess so that the nestable feature of the housing 10 is not prevented by the inclusion of a handle. The handle 22 is held in the retracted position by bumps or protrusions (not shown) on the wall portions 23 which engage the sides of the handle. These bumps or protrusions (not shown) also serve to engage the sides of the handle 22 when it is pivoted through 90° to the extended or usable position (not shown), for the purpose of retaining the handle in the usable position until it is forced back to the retracted position.

According to the embodiment of FIGS. 5–8 the plastics material is opaque and thus it is not possible to view the contents of the box from outside when it is closed. Therefore, a label 24 or alternatively a label holder (not shown) may be provided on the front of the box within the handle recess.

Figure 7:
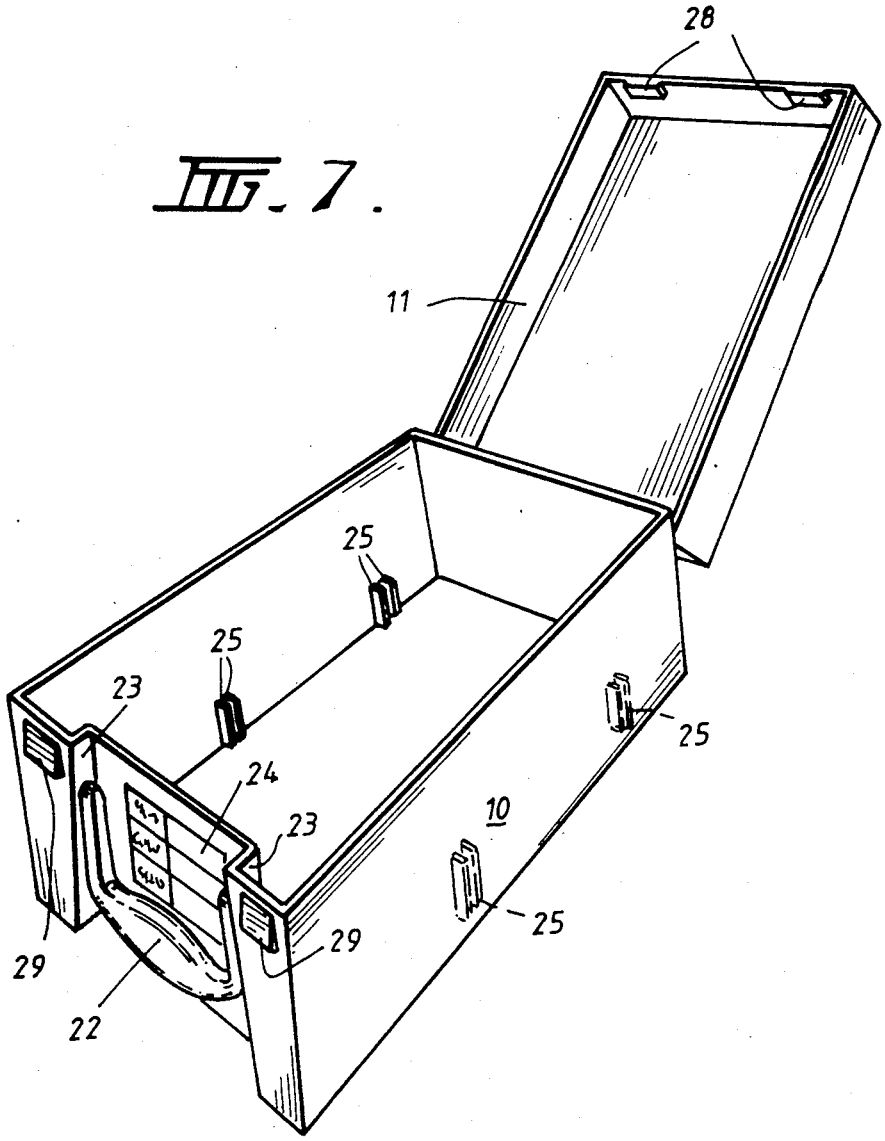
FIG. 7 is the same view as FIG. 5 with lid in the open position.
Figure 8:
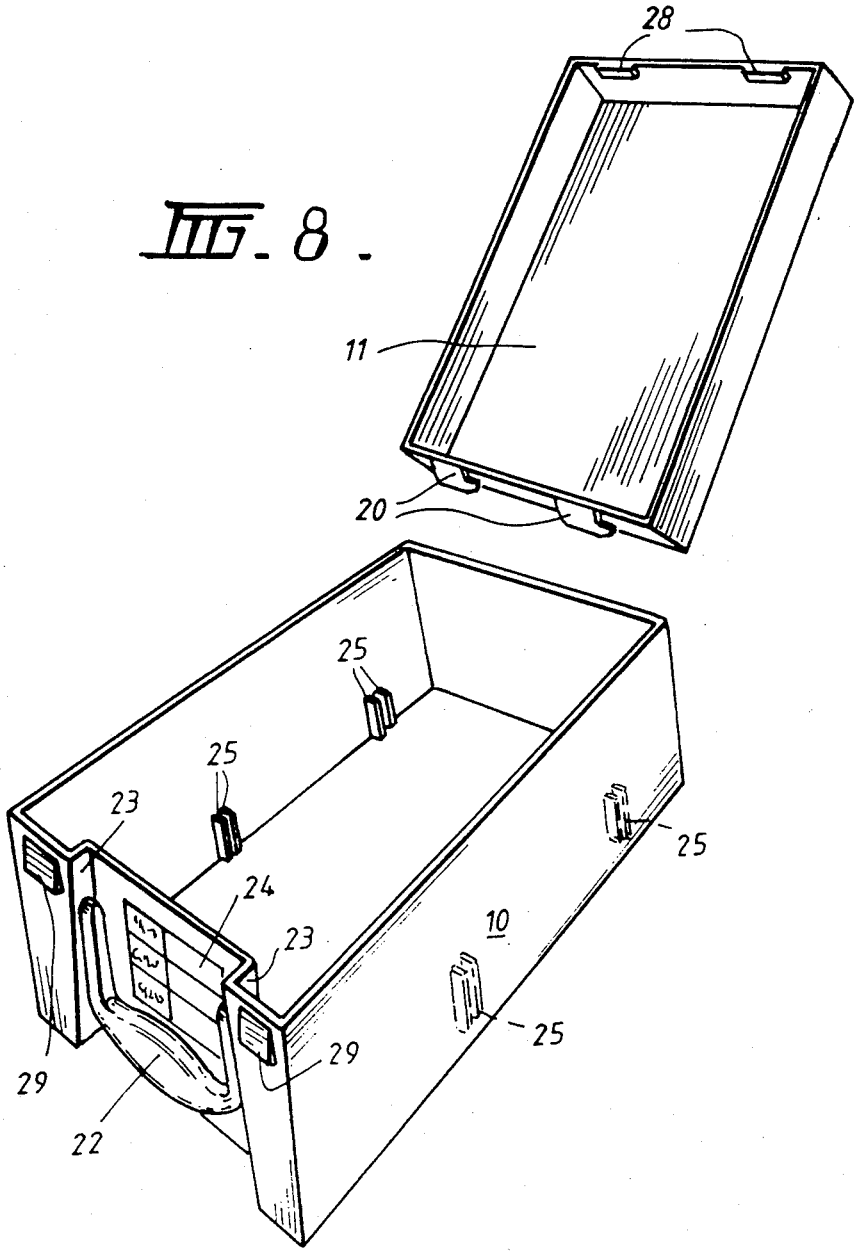
FIG. 8 is the same view as FIGS. 5 and 7 with lid unattached.

As is evident in FIGS. 7 and 8 the housing 10 has ribs 25 formed on the inner wall of opposed sides. Each pair of closely spaced ribs 25 define a groove for accommodating the edge of a baffle member (not shown) which is adapted to slide downwardly into the opposed grooves to extend across the width of the housing. Thus a single baffle member may be used to extend across the housing between either the opposed grooves towards the front of the box or alternatively the opposed grooves towards the rear of the box to thereby reduce the size of the space therein used to accommodate a pair of shoes. With one baffle in place as aforementioned the box is adapted to accommodate maids or youths shoes for example. With two baffles in place within the housing the central space between the baffles is adapted to accommodate shoes for very small children. Of course with no baffles in place the box accommodates adult shoes. The ribs 25 may be moulded integrally with the housing 10 or may be subsequently affixed thereon. The lid 11 of this embodiment has a raised perimeter portion 26 defining a central recess 27. The central recess is adapted to accommodate the base of a further similar shoe box when stacked thereon so as to prevent sliding movement between boxes in a stack similar to the groove 17 and ridge members 18 of the earlier embodiment.

Blocks 28 inside the downwardly depending side 19 of the lid 11 at the front of the lid co-operate with tapered blocks 29 arranged on the front end of the housing 10 adjacent the top thereof for the purpose of latching the lid 11 in a closed position. It is merely necessary to apply a slight pressure to the front of the housing 10 adjacent the blocks 29 in order to release the lid.

Reference should now be made to FIGS. 9–12 inclusive.

Figure 9:
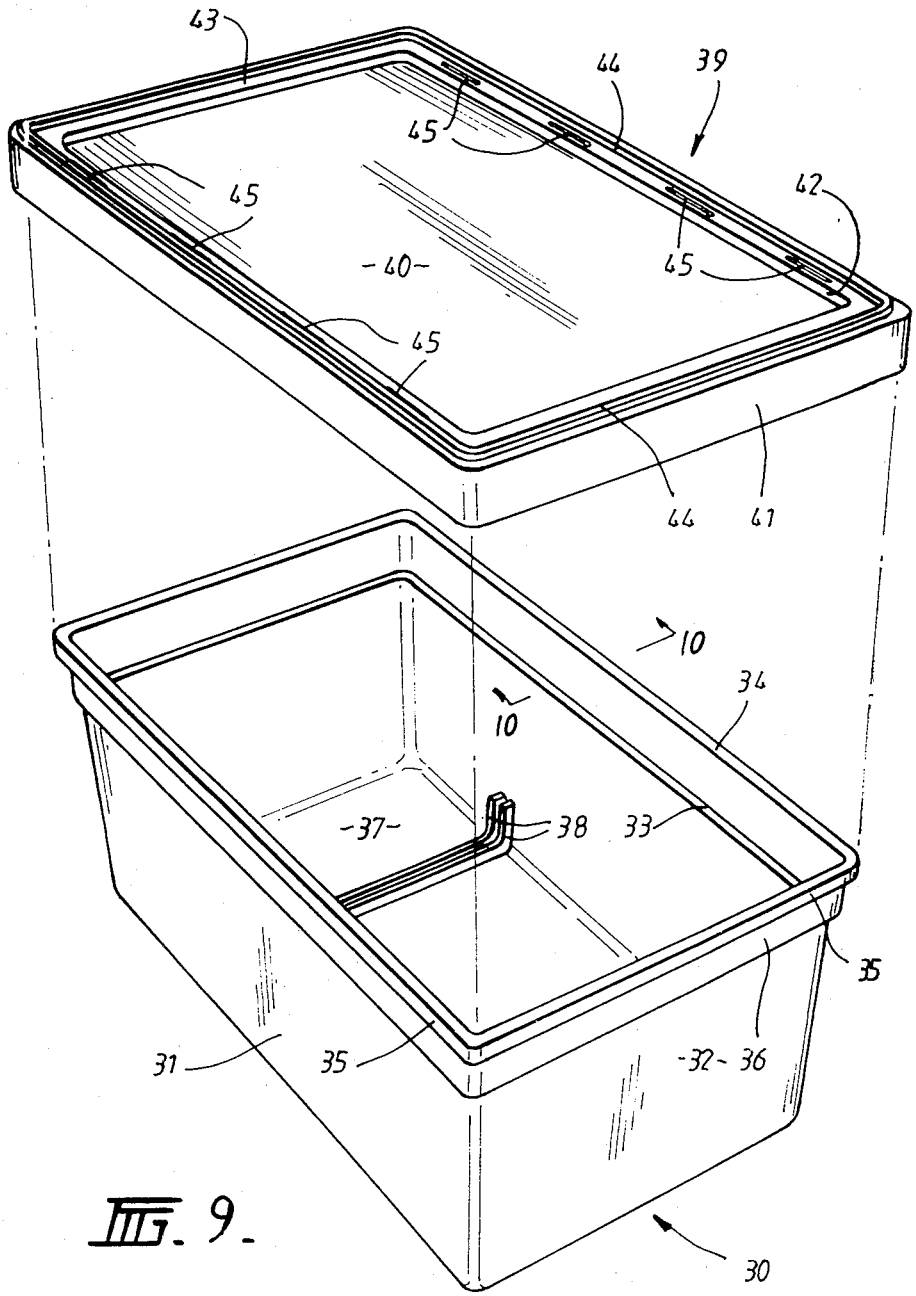
FIG. 9 is a perspective view from above of a shoe box and lid according to a still further embodiment of the invention with lid in a raised position.

The box 30 shown in FIG. 9 is of plastics material and is formed by an injection moulding process. The sides 31 and ends 32 of the box are inclined upwardly and outwardly to the point of horizontal step 33 above which the sides 31 and ends 32 extend vertically to the top edge 34 of the box which has a downturned lip 35. The top edge 34 is provided by an outwardly and downwardly turned portion of the upper edge of the walls. The top edge provides a bearing surface for the lid and contributes to the rigidity of the housing. The vertically extending portion 36, top edge 34, downturned lip 35 and horizontal step 33 serve to provide structural integrity to the box 30. The aforementioned integers towards the top of the sides 31 and ends 32 provide an enlarged upper section to the box 30.

Figure 12:
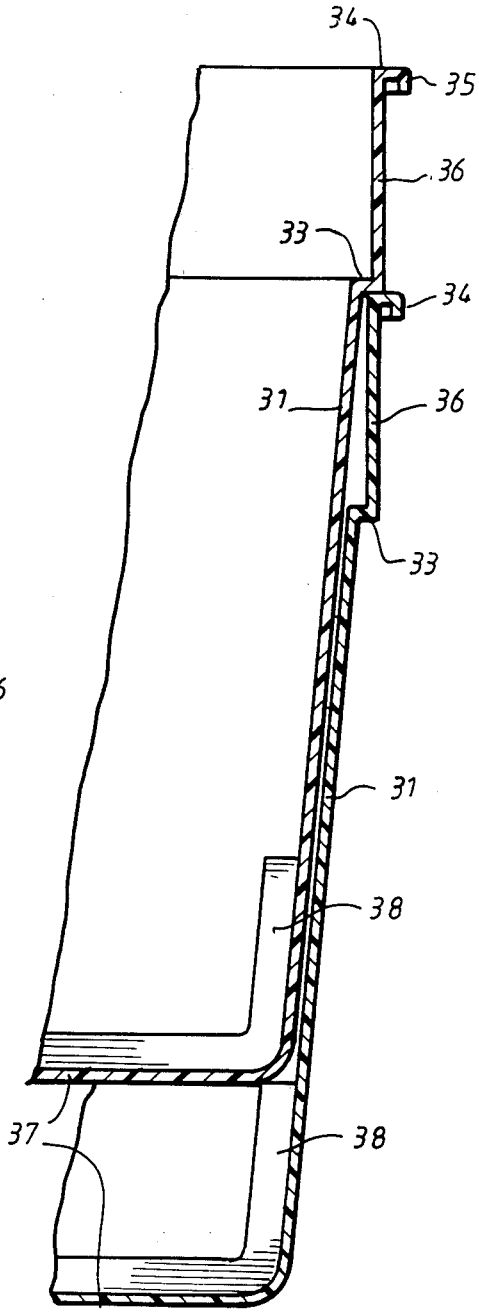
FIG. 12 is a part sectional view of the box showing a further box nested therein.

It will be evident that the upward and outward inclination of the sides 31 and ends 32 enables one box to be nested inside another as shown in FIG. 12 but complete nesting is prevented by the horizontal step 33 bearing on the top edge 34 of the lower of the two boxes due to the vertical orientation of the portion 36. This incomplete nesting means that a small air gap exists between the sides 31 and the ends 32 of the respective boxes which facilitates easy removal of a box which is nested in another box. As a further assurance that the boxes do not become completely nested one within the other, the base 37 of the upper box in a nest bears on the top edge of partition walls 38 of the box immediately therebelow as is again evident in FIG. 12. In other words, when the horizontal step 33 bears on the top edge 34, the base 37 bears on the upper edge of partition walls 38 thereby insuring that one box cannot become completely nested within another. Complete nesting makes it very difficult to separate the two boxes.

As mentioned above, partition walls 38 extend across the base 37 of the box and a short distance up the opposite sides 31. There are two pairs of partition walls 38 although only one pair is visible in FIG. 9. Each pair of partition walls 38 is spaced from an end 32 approximately one quarter of the distance between the ends 32. Each pair of partition walls 38 defines a small space therebetween which enables a partition (not shown) to be slid downwardly therebetween to divide the box 30 into two parts, one part being three quarters of the distance between the ends 32 and the other part being one quarter of the distance between the ends 32. In the event that a partition is arranged in the space between each pair of partition walls 38, the distance between the partitions is equal to half the length of the box. The partitions enable division of the box into smaller compartments to facilitate use with childrens' shoes or shoes which are smaller than the standard shoes for which the box is designed.

Figure 10:
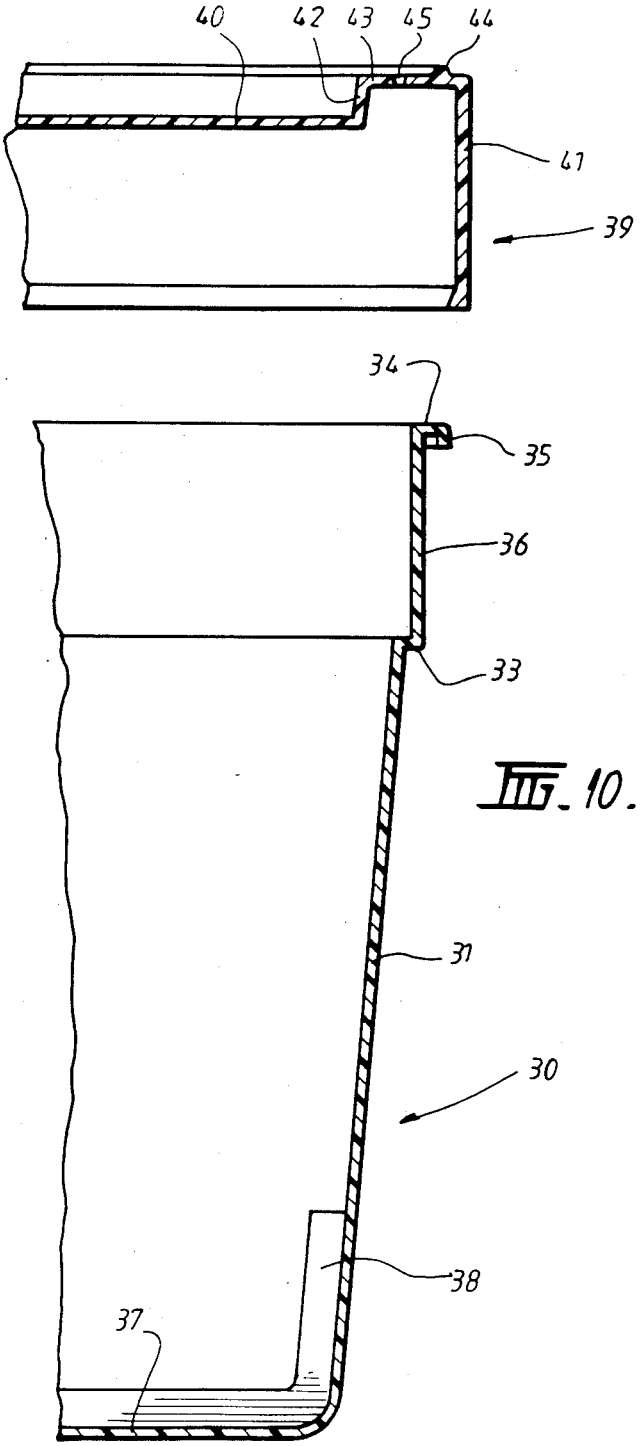
FIG. 10 is a part sectional view on the line 10—10 of FIG. 9.
Figure 11:
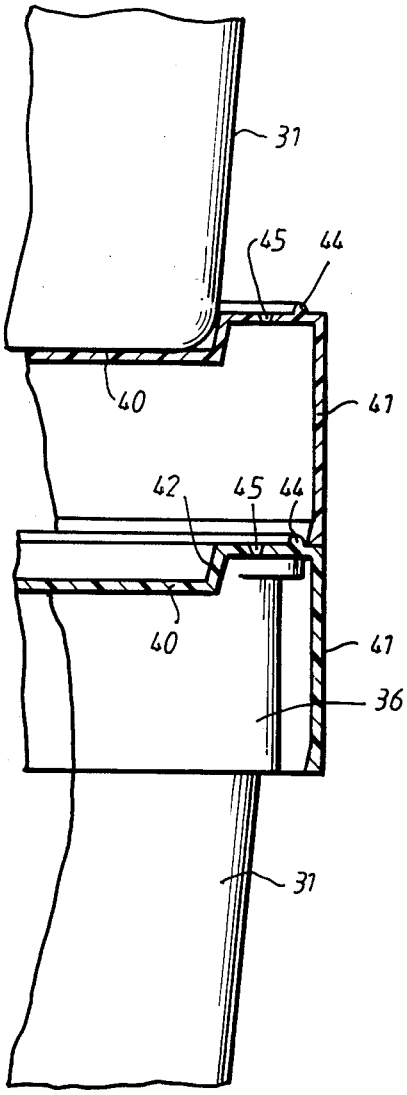
FIG. 11 is a part sectional view showing the top of the box with lid thereon and showing a further lid and box stacked thereon.

A lid 39 for the box 30 is shown in FIGS. 10 and 11. The lid 39 consists essentially of a flat top portion 40 and downwardly depending vertical sides 41. The sides 41 are connected to the top portion 40 by a stepped portion 42 which provides an up raised horizontal shelf 43 which extends around the perimeter of the lid on the top surface thereof. An upwardly projecting ridge 44 extends around the horizontal shelf 43 close to the outer edge thereof.

As is evident in FIG. 11, the lids may be stacked one on top of the other for storage or transportation purposes and although they do not nest together like the boxes, they are adapted to be stacked in a manner which provides a relatively stable stack. To this end, the lower edge of the vertical sides 41 has a thickened portion which, as well as providing additional strength and rigidity to the lid, provides a surface which is thicker than the sides 41 for bearing on the top portion 40 of a further lid. The thickness of the bottom portion of the sides 41 is about equal to the distance between the outer edge of the horizontal shelf 43 and the ridge 44. The ridge 44 bears on the inside surface of the thickened portion of the sides 41 and provides rigidity to the lid which is stacked thereon.

A series of vents 45 are spaced along the horizontal shelf 43 at opposite sides of the lid. There are four vents along each side which provide ventilation to the inside of the box when the lid is placed thereon. This ventilation is important since it is critical to the packaging of footwear, particularly leather footwear, that certain air flow is provided to the footwear to prevent the formation of a fungus on the leather which forms a misty coating thereon due to the tanning process. With conventional leather shoe boxes, the imperfect fit of the lid is sufficient to facilitate a small air flow for this purpose but with the more precise fit of the lid of the present invention, it is most desirable to provide the aforementioned vents.

As is evident above, the top portion 40 of the lid is sunken relative to the horizontal shelf 43 and the dimensions of the sunken portion are equivalent to the dimensions of the base 37 of the box 30. Thus, as is evident in FIG. 11, when one box is placed on top of another, the base 37 fits within the depressed portion of the lid and sliding movement between stacked boxes is prevented. This contributes substantially to the stability of a stack of the boxes 30.

The box described above in relation to FIGS. 9–12 is formed by an injection moulding process but could also be formed by vacuum moulding. The box and lid may be formed of clear plastics material whereby the contents thereof can be readily observed from outside the box. Alternatively, the box and lid may be moulded in opaque form in various colours to enhance the aesthetics of the box or to depict shoes of various types. It should be mentioned that the partition walls 38 also serve as a heel stop when a baffle is not inserted in the box and in addition the partition walls 38 form strengthening ribs to enhance the structural strength of the box. The moulded box and lid have a certain degree of flexibility and sufficient rigidity to support thereon a considerable number of like boxes containing footwear. The strength and rigidity is achieved, as previously mentioned, by means of the partition walls 38 and the enlarged upper portion of the box containing the downturned lip 35. Similarly, the stepped portion 42 of the lid enhances the structural strength thereof.

It should be evident that the present invention provides considerable improvement over conventional shoe boxes. For example, the box or package in simplest form is extremely cheap to manufacture, enables the goods to be viewed from outside the container if desired and is readily stored one inside the other for storage or disposal purposes. Furthermore, the indexing arrangement which allows the bottom of one box to engage in the top of another box provides considerable stability when the boxes are stored one on top of the other. Viewing of the shoes within the box from outside enables a salesman or prospective purchaser to select goods from a stack without necessarily removing a box or package.

Whilst several embodiments of the invention are disclosed above, it is readily apparent that many other combinations of the various features disclosed may be used to provide many differing embodiments. Clearly the shoe box of FIGS. 5–8 is more expensive to produce than the shoebox shown in FIGS. 1–4 or 9–12 but it should be noted that the greater structural integrity together with the hinged lid and carry handle render this version suitable as a carry container for the shoes obviating the need for a separate carry bag such as a plastics carry bag normally provided free by the shopkeeper to the purchaser. Also, the shoe-box may be retained as a permanent storage for the shoes when not in use.

It will be evident that the use of plastics material for construction and the nestling feature render the shoe box or package of this invention both economical in manufacture and storage.

I claim:

1. A shoe box comprising a housing for containing footwear, said housing having a base, an open top opposed side walls and opposed end walls, a lid for covering said top, said housing and lid being formed of plastics material moulded to the desired shape and having some flexibility when moulded and sufficient rigidity to support thereon, a considerable number of like shoe boxes containing footwear when said boxes are stacked, said walls extending upwardly and outwardly from said base, to form a slightly tapering housing, at least one pair of closely spaced partition walls extending inside said housing on said base and having a height sufficient to support a baffle wall for dividing said housing into smaller compartments and to prevent complete nesting when one housing is placed within another, said lid having a flat top, a raised perimeter portion around said flat top and downwardly depending sides for extending over the upper part of the walls of said housing, said sides being norma 1 to said flat top and said flat top accommodating the base of a further box when a plurality of boxes are stacked whereby said raised perimeter portion prevents sliding movement between the stacked boxes, means on said lid for facilitating stacking of a plurality of lids and said lid having vent means for enabling a small amount of air to circulate into said housing when said lid is placed thereon.

2. A shoe box according to claim 1, wherein said walls have an outwardly stepped portion towards the top thereof, the walls above said stepped portion extending vertically, that is, normal to said base and the upper edge of the walls being turned outwardly and downwardly to provide a bearing surface for said lid and to contribute to the rigidity of said housing, said stepped portion of said housing bearing on said bearing surface of a further housing when one housing is placed within another to further assist in preventing complete nesting.

3. A shoe box according to claim 2, wherein said means on said lid for facilitating stacking comprises a thicker edge portion on the lower edge of said downwardly depending sides and an upstanding ridge extending around said perimeter portion and spaced from the outer edge of said perimeter portion by a distance equal to the thickness of said thicker edge portion.

4. A shoe box according to claim 3, wherein said vent means comprise spaced apertures through said raised perimeter positioned to enable air ingress to said housing when said lid is placed thereon, said apertures being in the form of elongated slots.

5. A shoe box according to claim 4, wherein there are two pairs of said partition walls on said base, each said pair being spaced from respective end walls by a distance of about one quarter of the distance between said end walls, said partition walls having a greater height adjacent said respective side walls.

* * * * *